US008746841B2

(12) United States Patent
Ikeda

(10) Patent No.: US 8,746,841 B2
(45) Date of Patent: Jun. 10, 2014

(54) LIQUID JETTING APPARATUS

(75) Inventor: Ayumu Ikeda, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 13/545,751

(22) Filed: Jul. 10, 2012

(65) Prior Publication Data

US 2013/0016158 A1 Jan. 17, 2013

(30) Foreign Application Priority Data

Jul. 11, 2011 (JP) ..... 2011-152515

(51) Int. Cl.
*B41J 2/165* (2006.01)

(52) U.S. Cl.
USPC ..... 347/33

(58) Field of Classification Search
None
See application file for complete search history.

(56) References Cited

U.S. PATENT DOCUMENTS

| | | | | |
|---|---|---|---|---|
| 6,739,707 | B2 | 5/2004 | Shimizu et al. | |
| 7,229,163 | B2 | 6/2007 | Shimizu et al. | |
| 2005/0195240 | A1 | 9/2005 | Hiraki | |
| 2005/0248613 | A1 * | 11/2005 | Fujikawa | 347/33 |

FOREIGN PATENT DOCUMENTS

| | | | |
|---|---|---|---|
| JP | 2000-103069 | A | 4/2000 |
| JP | 2005-246929 | A | 9/2005 |
| JP | 2006-150599 | A | 6/2006 |

* cited by examiner

*Primary Examiner* — Alejandro Valencia
(74) *Attorney, Agent, or Firm* — Baker Botts L.L.P.

(57) ABSTRACT

A liquid jetting apparatus includes: a liquid jetting head configured to have a liquid jetting surface on which a plurality of nozzles, from which liquid is jetted, are open; a wiper configured to move, relative to and along the liquid jetting surface, while being brought in contact with the liquid jetting surface and to wipe the liquid adhered on the liquid jetting surface; a wiper movement mechanism configured to move the wiper in a direction orthogonal to the liquid jetting surface and to make the wiper approach to or separate from the liquid jetting surface. The wiper moving mechanism includes: a cam configured to have a cam surface; an axis configured to extend along the liquid jetting surface; and an arm member configured to make the wiper approach to the liquid jetting surface by pushing and moving the wiper in accordance with movement of the cam.

7 Claims, 9 Drawing Sheets

LIQUID JETTING APPARATUS

CROSS REFERENCE TO RELATED APPLICATION

The present application claims priority from Japanese Patent Application No. 2011-152515, filed on Jul. 11, 2011, the disclosure of which is incorporated herein by reference in its entirety.

BACKGROUND OF THE INVENTION

1. Field of the Invention

The present invention relates to a liquid jetting apparatus which jets liquid.

2. Description of the Related Art

There have been known liquid jetting apparatuses, each of which include a liquid jetting head having a liquid jetting surface on which a plurality of nozzles are open to jet the liquid and a wiper which wipes the liquid adhered to the liquid jetting surface. Each of the liquid jetting apparatuses is usually configured such that the wiper is moved in an intersecting direction with respect to the liquid jetting surface which intersects or crosses the liquid jetting surface (hereinafter referred to as "direction intersecting the surface"), thereby making it possible for the wiper to approach to or separate from the liquid jetting surface. Among the liquid jetting apparatuses, there is a liquid jetting apparatus in which a cam mechanism is used as a driving mechanism for driving the wiper, in the direction intersecting the surface, to approach to the liquid jetting surface.

For example, Japanese Patent Application laid-open No. 2005-246929 discloses an ink-jet printer which jets ink on a recording paper sheet to record an image etc., as the liquid jetting apparatus having the wiper. In the ink jet printer described in Japanese Patent Application laid-open No. 2005-246929, an end portion of the wiper makes contact with a front end portion of a cam follower which is engaged with a cam groove of a rotary cam. A cam surface, of the cam groove, which comes into contact with the cam follower is constructed of a surface parallel to the liquid jetting surface and a raised portion which continues to the surface parallel to the liquid jetting surface in a rotating direction of the rotary cam and is raised with respect to the surface parallel to the liquid jetting surface. In a case that the cam follower is brought in contact with the surface, of the cam surface, which is parallel to the liquid jetting surface, the wiper is away from the liquid jetting surface. In a case that the cam follower is separated from the surface parallel to the liquid jetting surface by rotation of the rotary cam to be pushed and moved upward while being brought in contact with the raised portion, the wiper is also pushed and moved upward by the cam follower to come into contact with the liquid jetting surface in accordance with the movement of the cam follower. As described above, in the ink-jet printer described in Japanese Patent Application laid-open No. 2005-246929, the wiper is directly driven by the rotary cam.

In the ink-jet printer as described above, the cam follower gradually goes up a sloped surface of the raised portion of the cam surface in the process in which the wiper separated from the liquid jetting surface approaches to the liquid jetting surface. In this situation, not only the force generated in a direction in which the wiper approaches to the liquid jetting surface but also the force generated in a tangential direction with respect to a rotating path of the rotary cam is applied to a base end portion, of the cam follower, which is brought in contact with the slope surface of the cam surface. Therefore, the cam follower is pushed and moved upward in an obliquely incline posture in some cases. Then, the following situation may arise. That is, a position, of the wiper, which is pushed and moved upward by being brought in contact with the cam follower is deviated, and thereby the wiper approaches to the liquid jetting surface in the obliquely incline posture. As described above, when the wiper approaches to the liquid jetting surface in an unstable posture in which the wiper is inclined in the tangential direction with respect to the rotating path of the rotary cam, various problems would be caused. For example, when the wiper is moved in the obliquely incline posture, the wiper would deviate from a moving path of a case in which the wiper is moved upright without being inclined obliquely. As a result, the wiper would come into contact with surrounding constitutive parts or components, thereby damaging the wiper and the constitutive parts or components brought in contact with the wiper.

Further, in the ink-jet printer described in Japanese Patent Application laid-open No. 2005-246929, the wiper is required to be arranged directly above the rotary cam; and the wiper and the rotary cam are required to be arranged as a pair in a design of the ink-jet printer. Thus, the ink-jet printer described in Japanese Patent Application laid-open No. 2005-246929 is more likely to be subject to restriction of the arrangement, thereby decreasing degree of freedom of the arrangement of the wiper.

SUMMARY OF THE INVENTION

In view of the above, an object of the present teaching is to provide a liquid jetting apparatus, which is configured so that a wiper is capable of approaching to a liquid jetting surface in a correct posture without being inclined obliquely and which has high degree of freedom of arrangement of the wiper.

According to an aspect of the present teaching, there is provided a liquid jetting apparatus which jets liquid, including: a liquid jetting head configured to have a liquid jetting surface on which a plurality of nozzles, from which the liquid is jetted, are open; a wiper configured to move, relative to and along the liquid jetting surface, while being brought in contact with the liquid jetting surface and to wipe the liquid adhered on the liquid jetting surface; a wiper movement mechanism configured to move the wiper in a first direction, which is orthogonal to the liquid jetting surface and approaches to the liquid jetting surface, and a second direction which is an opposite direction of the first direction; and to make the wiper approach to or separate from the liquid jetting surface; wherein the wiper movement mechanism includes: a cam configured to have a cam surface; an axis configured to extend along the liquid jetting surface; and an arm member configured to make the wiper approach to the liquid jetting surface by pushing and moving the wiper in accordance with movement of the cam, and the arm member includes: a contact portion configured to make contact with the cam surface and to move in the first direction and second the direction; a support portion configured to be supported by the axis at a position which is different from the contact portion; and an action portion configured to make contact with the wiper at a position which is different from the support portion, and to make the wiper approach to the liquid jetting surface by pushing and moving the wiper in a state of being brought in contact with the action portion in accordance with movement of the contact portion.

According to the aspect of the present teaching, when the contact portion moves (force is applied to the point where the force is to be applied) in accordance with the movement of the cam, the action portion (the point of action) swings with the support portion as the center to make contact with the wiper, and thereby the wiper is pushed and moved. Accordingly, the wiper approaches to and makes contact with the liquid jetting surface. In this situation, since the arm member which pushes and moves the wiper is supported by the axis extending along the liquid jetting surface, a tilt of the wiper around the axis which connects the support portion of the arm member and the action portion of the arm member, that is, a tilt of the wiper in a tangential direction with respect to a rotating path of the cam, is regulated. Thus, the wiper can approach to the liquid jetting surface in a correct posture. Further, since the arm member is provided between the wiper and the cam, arrangement of the wiper is not restricted by arrangement of the cam and the degree of freedom of the arrangement of the wiper is enhanced.

DESCRIPTION OF THE PREFERRED EMBODIMENTS

Figure 1:
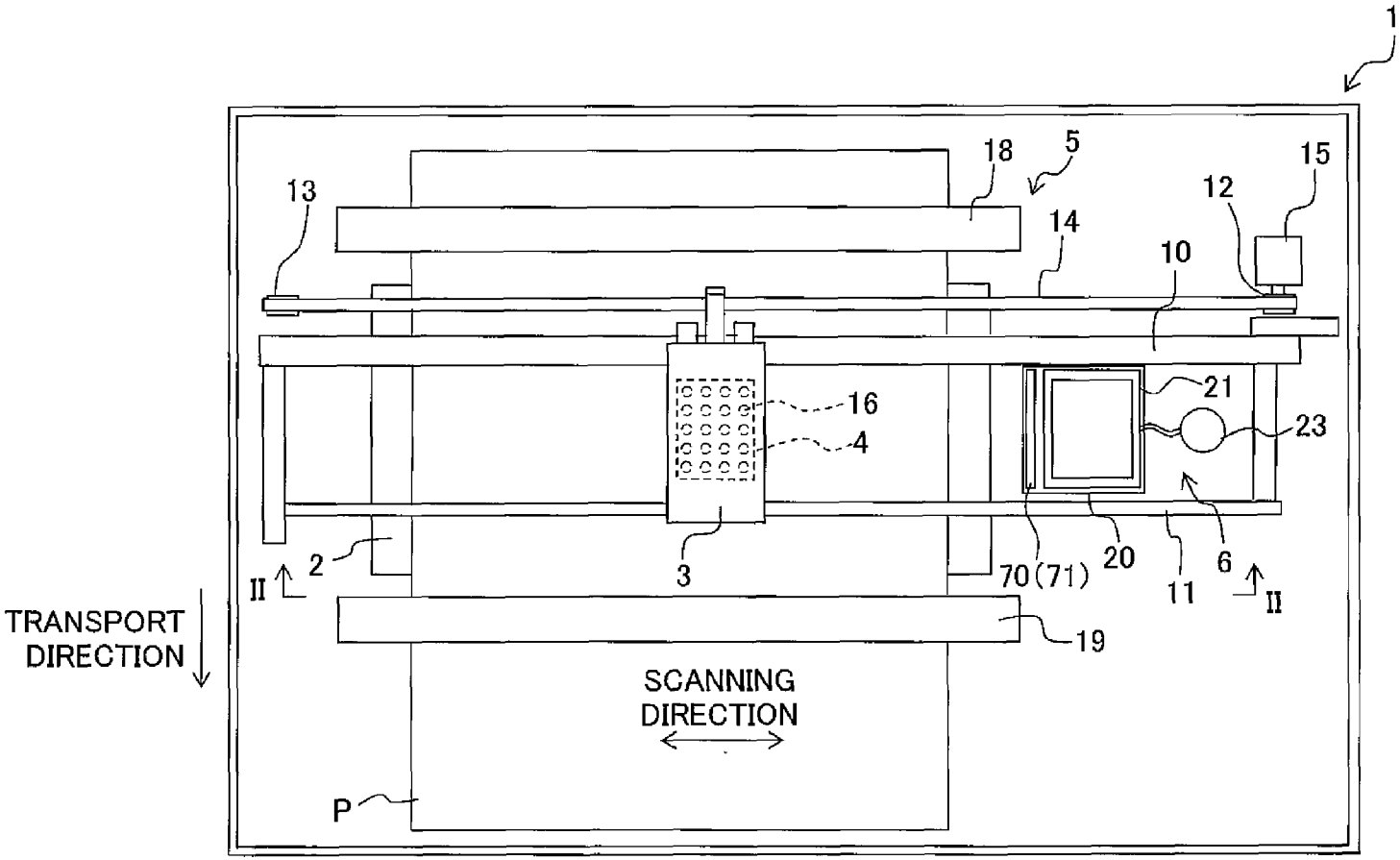
FIG. 1 is a plan view schematically showing a construction of an ink-jet printer according to this embodiment.

Next, an embodiment of the present teaching will be explained. In the present description, a frontward direction, a rearward direction, a left side (left direction), and a right side (right direction) in the plan view of FIG. 1 are defined as the frontward direction, the rearward direction, the left side (left direction), and the right side (right direction), respectively. Further, a direction perpendicular to the sheet surface of FIG. 1 (upward and downward directions in the front view of FIG. 2) is defined as the upward and downward directions. These definitions are appropriately used in the following description.

Figure 2:
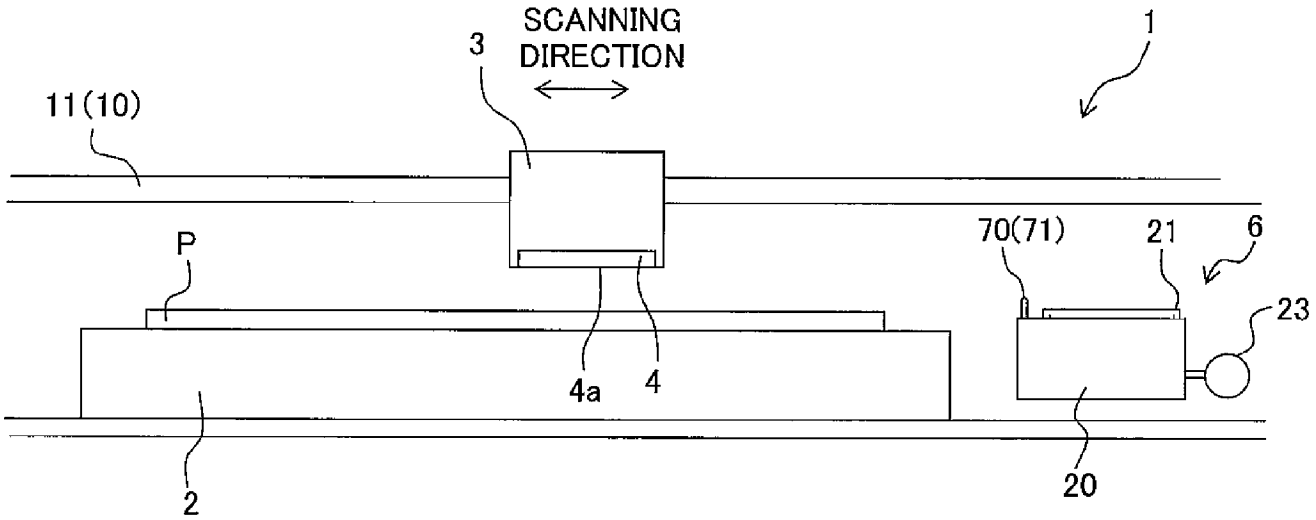
FIG. 2 is a view taken along line II-II in FIG. 1.

As shown in FIGS. 1 and 2, an ink-jet printer 1 (liquid jetting apparatus) includes, for example, a platen 2 on which a recording paper sheet P is placed, a carriage 3 which is configured to be reciprocatively movable in a scanning direction parallel to the platen 2, an ink-jet head 4 (liquid jetting head) which is carried on the carriage 3, a transport mechanism 5 which transports the recording paper sheet P in a transport direction perpendicular to the scanning direction, and a maintenance unit 6 which performs various maintenance operations in relation to recovery and maintenance of liquid jetting performance of the ink-jet head 4.

The recording paper sheet P supplied from an unillustrated paper feed mechanism is placed on an upper surface of the platen 2. Two guide rails 10, 11 extending parallel in a left-right direction (scanning direction) of FIG. 1 are provided over or above the platen 2. The carriage 3 is configured to be reciprocatively movable in the scanning direction along the two guide rails 10, 11 in an area facing the platen 2. Further, the two guide rails 10, 11 extend to a position (maintenance position) separated in the rightward direction as shown in FIG. 1 along the scanning direction from the platen 2. The carriage 3 is constructed to be movable from an area (recording area) facing the recording paper sheet P on the platen 2 to the maintenance position as a non-recording area.

Further, an endless belt 14 wound and applied between two pulleys 12, 13 is connected to the carriage 3. When the endless belt 14 is driven to travel by a carriage driving motor 15, the carriage 3 is moved in the scanning direction in accordance with the travel of the endless belt 14.

The ink-jet head 4 is attached to a lower portion of the carriage 3. A plurality of nozzles 16 are formed on the lower surface of the ink-jet head 4 which is parallel to the upper surface of the platen 2. That is, the lower surface of the ink-jet head 4 is an ink-jetting surface 4*a* (liquid jetting surface). Ink is jetted from the plurality of nozzles 16 of the ink-jetting surface 4*a* toward the recording paper sheet P placed on the platen 2.

The transport mechanism 5 has two transport rollers 18, 19 which are disposed on opposite sides of the platen 2 to interpose the platen 2 in the transport direction. The recording paper sheet P, which is placed on the platen 2, is transported in the transport direction (frontward direction as viewed in FIG. 1) by the two transport rollers 18, 19.

The ink-jet printer 1 jets the ink from the ink-jet head 4, which is reciprocatively moved in the scanning direction (left-right direction as shown in FIG. 1) together with the carriage 3, with respect to the recording paper sheet P placed on the platen 2, and at the same time, the ink-jet printer 1 transports the recording paper sheet P in the transport direction by the two transport rollers 18, 19. Accordingly, the ink-jet printer 1 prints a desired image, letters, and the like, on the recording paper sheet P.

The maintenance unit 6 executes a suction purge, in which the ink is sucked and discharged from the nozzles 16 to remove any foreign matters, bubbles, etc., mixed in the ink-jet head 4, and a wiping of the ink adhered to the ink-jetting surface 4*a*. That is, the maintenance unit 6 is provided to recover and maintain the ink jetting performance of the ink-jet head 4.

The maintenance unit 6 is disposed on a moving path in the scanning direction of the carriage 3 at a position, which is separated from the platen 2 toward the right side in FIG. 1 in the scanning direction. In other words, the maintenance unit 6 is arranged at a position at which the ink-jetting surface 4*a* faces the maintenance unit 6 in a case that the ink-jet head 4 moves to the maintenance position as the non-recording area together with the carriage 3. The maintenance unit 6 is provided with a maintenance base 20, a suction cap 21 which makes contact with the ink-jetting surface 4*a* of the ink-jet head 4 to cover the nozzles 16, a suction pump 23 which is connected to the suction cap 21, and a wiper 70 which wipes the ink adhered on the ink-jetting surface 4*a* after the suction purge, etc.

At first, the suction cap 21 will be explained. The suction cap 21 is formed of a flexible material such as rubber or a synthetic resin. The suction cap 21 is installed to be movable in the upward and downward directions with respect to the maintenance base 20. The suction cap 21 is arranged to face the ink-jetting surface 4*a* of the ink-jet head 4 in the case that the ink-jet head 4 is placed at the maintenance position. The suction cap 21 is driven obliquely upward by an unillustrated elevating mechanism in a state that the suction cap 21 is opposed to the ink-jetting surface 4*a*. Accordingly, the suction cap 21 comes into close contact with the ink-jetting surface 4*a* of the ink-jet head 4 to cover the nozzles 16. The elevating mechanism described above moves the suction cap 21 obliquely upward from a position separated from the ink-jetting surface 4*a* to a position at which the suction cap 21 is brought in tight contact with the ink-jetting surface 4*a* so that the suction cap 21 is separated from a printing area with respect to the scanning direction in cooperation with the carriage 3 which moves from the printing area to the maintenance position in the scanning direction (for example, see Utility Model Registration No. 2577653).

When the suction pump 23 is driven in the state that the suction cap 21 is brought in tight contact with the ink-jetting surface 4*a* to cover the nozzles 16, air in a closed space, which is defined by the suction cap 21 and the ink-jetting surface 4*a*, is sucked to reduce pressure. In this situation, the ink in the ink-jet head 4 is sucked and discharged (suction purge) from the nozzles 16 into the suction cap 21. Accordingly, it is possible to discharge viscosity-increased ink in the nozzles 16 and the bubbles mixed in ink channels in the ink-jet head 4 from the nozzles 16 together with the ink. The suction purge is performed at predetermined time intervals or after a timing at which the bubbles are more likely to be mixed in the ink channels in the ink-jet head 4, such as after an exchange of the cartridge.

Figure 3:
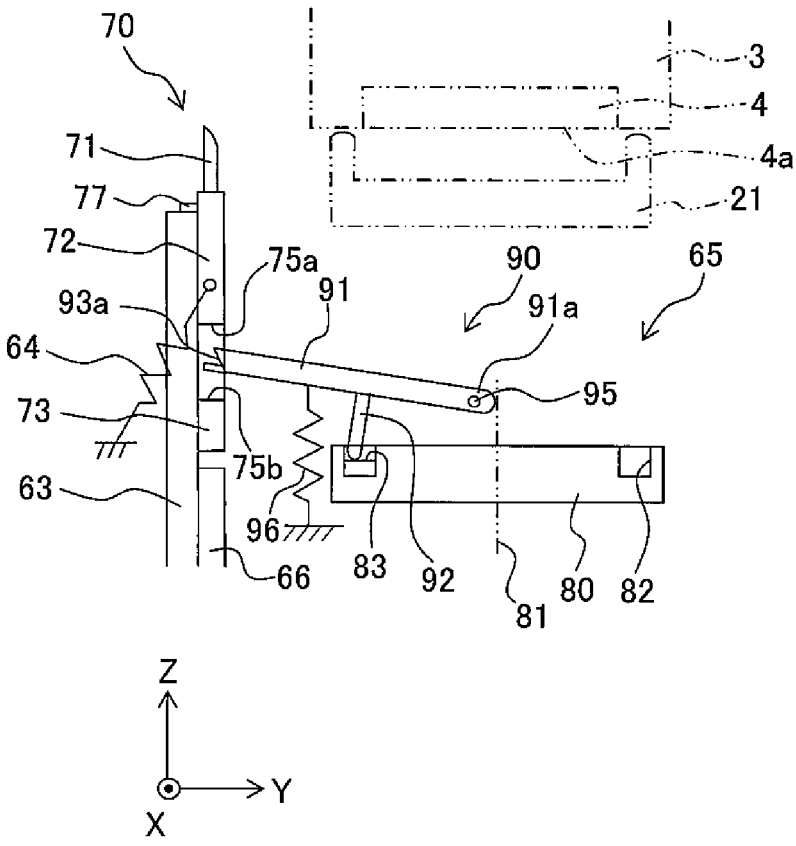
FIG. 3 is a side view of a wiper and a wiper movement mechanism as viewed in a transport direction.
Figure 4:
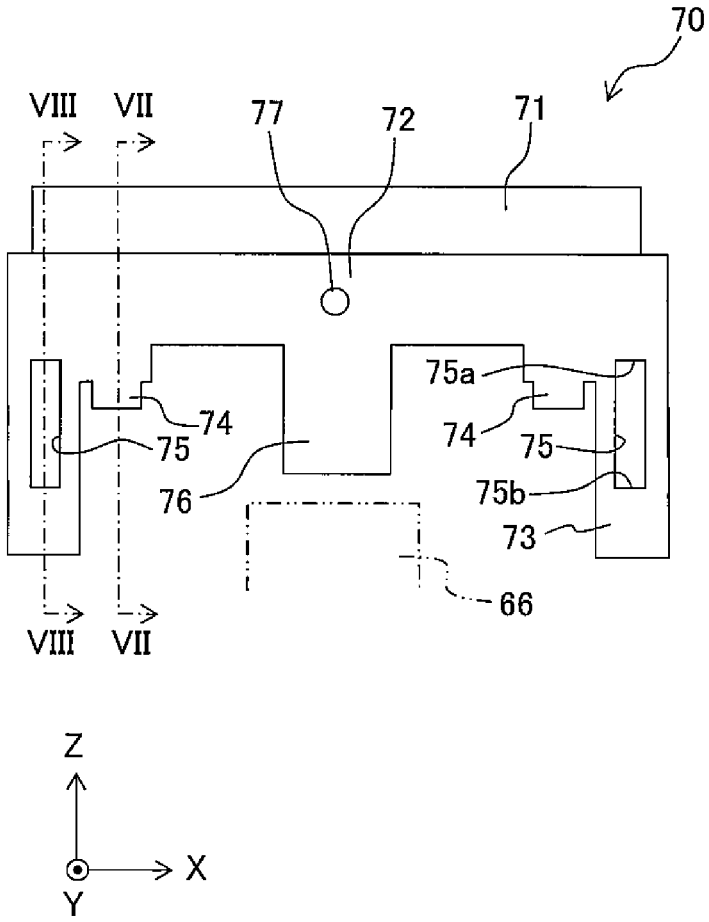
FIG. 4 is a front view of the wiper as viewed in a scanning direction.

Next, the wiper 70 will be explained. As shown in FIGS. 3 and 4, it is appropriately defined in the following description that the transport direction is the X direction, the scanning direction is the Y direction, and the upward-downward direction is the Z direction.

As shown in FIGS. 1 and 2, the wiper 70 is disposed adjacently to the suction cap 21 in the maintenance base 20 on a side closer to the printing area with respect to the scanning direction than the suction cap 21. The wiper 70 is installed to be movable in the upward and downward directions with respect to the maintenance base 20. The wiper 70 is driven upward and downward between a wiping position at which the wiper 70 is brought in contact with the ink-jetting surface 4*a* and a retract position at which the wiper 70 and the ink-jetting surface 4*a* are in a separated state, by a wiper movement mechanism 65 (see FIG. 3).

As shown in FIGS. 3 and 4, the wiper 70 includes a wiper member 71 and a wiper holder 72 holding the wiper member 71. The wiper member 71 is a flat plate-shaped member which is made of an elastic material such as the rubber or the synthetic resin. The size of the wiper 70 in the transport direction (X direction) is the same as or not less than the width of the ink-jetting surface 4*a*. The wiper 70 is provided upstandingly to be parallel to the upward and downward directions. A projection 77 is formed on the surface of the wiper 70 on the side of the printing area at the substantially center portion in the upward and downward directions.

The wiper holder 72 is a member which has a flat shape and which is made of the synthetic resin etc. The wiper holder 72 is provided upstandingly to be parallel to the upward and downward directions, similarly to the wiper member 71; and holds the wiper member 71 from the lower surface of the wiper member 71. The wiper holder 72 includes two extending portions 73 which extend downward from both ends in the X direction (left and right directions of FIG. 4) respectively; two protruding portions 74, each of which projects downward and is arranged adjacently to an inner side of one of the two extending portions 73; and a stopper contact portion 76 which extends downward from the center portion in the X direction and can make contact with a stopper 66 as will be described later on. A through hole 75, which has a rectangular shape, penetrates in a thickness direction (Y direction), and extends in the upward and downward directions (z direction), is formed in each of the extending portions 73. A tip surface (lower surface) of the protruding portion 74 is positioned between an inner wall surface 75*a* on an upper side and an inner wall surface 75*b* on a lower side, those of which form the through hole 75, with respect to the upward and downward directions.

Next, an explanation will be made about the wiper movement mechanism 65. As shown in FIG. 3, the wiper movement mechanism 65 includes a support plate 63 which makes contact with a side surface of the wiper 70 on the side of the printing area to support the wiper 70, a tension spring 64 (an example of a first urging member) to urge or bias the wiper 70, the stopper 66 which supports the wiper 70 at the retract position from a lower side, an arm member 90 which moves the wiper 70 upward/downward, a tension spring 96 (an example of a second urging member) which pulls the arm member 90 downward, and a rotary cam 80 to swing the arm member 90.

The support plate 63 is formed to have a width which is approximately same as that of the wiper 70 in the X direction. The support plate 63 is fixed to the maintenance base 20 and contacts with a substantially lower half portion of the surface of the wiper 70 on the side of the printing area. The tension spring 64 connects both end portions of the wiper 70 to both end portions of the support plate 63 in the transport direction, respectively. One end portion of the tension spring 64 is connected to the substantial center portion of the wiper 70 in a height direction (Z direction), and the other end portion of the tension spring 64 is connected to the support plate 63. The other end portion of the tension spring 64 is connected to the maintenance base 20 on a side of the recording area with respect to the support plate 63. The tension spring 64 urges or biases the wiper 70 with respect to the support plate 63 in the left lower direction of FIG. 3. The stopper 66 is fixed to the maintenance base 20 and disposed at a position immediately below the stopper contact portion 76 of the wiper 70.

Figure 5A:
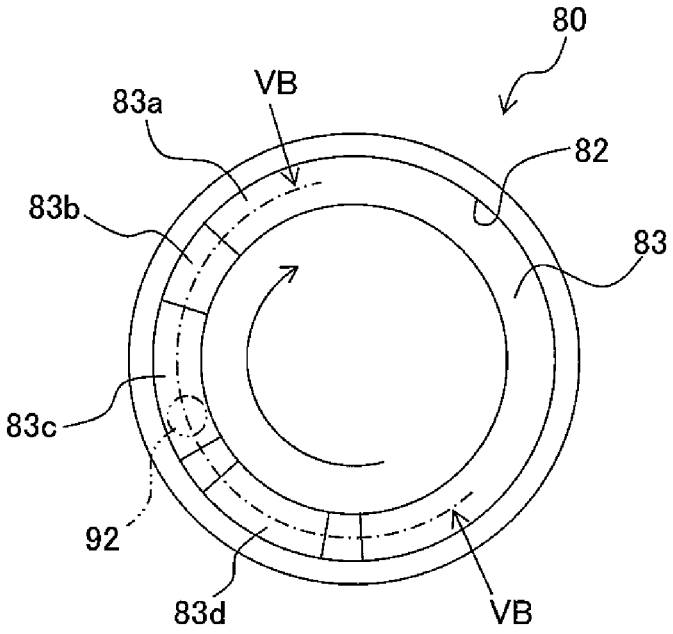
FIG. 5A is a plan view of a rotary cam as viewed from an upper surface thereof.

The rotary cam 80 is disposed at a position immediately below the suction cap 21; and rotates around a rotational axis 81 extending in the upward and downward directions (Z direction). As shown in FIG. 3 and FIG. 5A, a rounded ring-shaped cam groove 82 with the rotational axis 81 as a center is formed in the rotary cam 80. A lifting rod 92 of the arm member 90 as will be described later on comes into contact with a cam surface 83 of the cam groove 82.

Figure 5B:
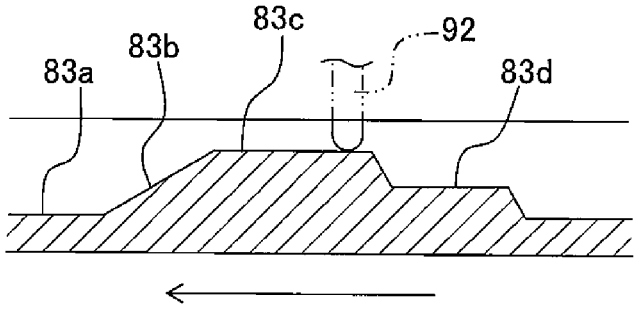
FIG. 5B is a cross-sectional view taken along alternate long and short dash lines VB-VB in FIG. 5A.

As shown in FIG. 5B, the cam surface 83 includes a separating surface 83*a* (the second surface) which separates the wiper 70 from the ink-jetting surface 4*a*, an inclined surface 83*b* which pushes the wiper 70 upward, an engaging surface 83*c* (the first surface) which engages the wiper 70 at the wiping position at which the wiper 70 can make contact with the ink-jetting surface 4*a*, and a standby surface 83*d* to permit standby of the arm member 90 at an interlevel position at which the arm member 90 does not make contact with the wiper 70.

The separating surface 83*a* is a surface which is parallel to the ink-jetting surface 4*a* and is the farthest from the ink-jetting surface 4*a* in the upward and downward directions. The engaging surface 83*c* is a surface which is parallel to the ink-jetting surface 4*a* and is the nearest to the ink-jetting surface 4*a* in the upward and downward directions. The inclined surface 83*b* is a surface which is inclined upward and connects an upstream end of the separating surface 83*a* to a downstream end of the engaging surface 83*c* with respect to the rotating direction of the rotary cam 80. The standby surface 83*d* is a surface which is parallel to the ink-jetting surface 4*a*; which continues to an upstream end of the engaging surface 83*c* via a stepped portion and continues to a downstream end of the separating surface 83*a* via another stepped portion with respect to the rotating direction of the rotary cam 80; and which is positioned between the separating surface 83*a* and the engaging surface 83*c* in the upward and downward directions.

Figure 6A:
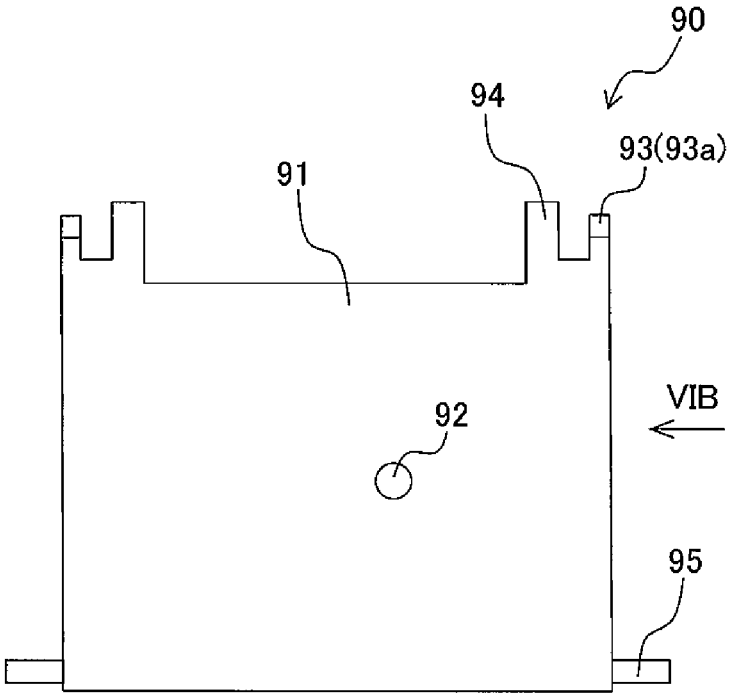
FIG. 6A is a plan view of an arm member as viewed from a back surface thereof.

As shown in FIG. 3, the arm member 90 includes a plate member 91 which is disposed between the rotary cam 80 and the suction cap 21 in the upward and downward directions and the lifting rod 92 (contact portion) which is coupled to the plate member 91. As shown in FIG. 6A, the plate member 91 is a rectangular shape as viewed in a plan view; and has two pushing-down portions 93 which respectively project from both ends of one of the end portions (upper end in FIG. 6) of the plate member 91 and two pushing-up portions 94, each of which is disposed adjacently to the inner side of one of the two pushing-down portions 93 and projects much further than each pushing-down portion 93.

Each of the two pushing-down portions 93 has a spacing distance which is the same as or equivalent to that of one of the two through holes 75 of the wiper 70; and can be inserted into one of the two through holes 75. Each of the two pushing-up portions 94 has a spacing distance which is the same as or equivalent to that of one of the two protruding portions 74 of the wiper 70. The two pushing-up portions 94 can make contact with the two protruding portions 74 respectively, in a state that the two pushing-down portions 93 can be inserted into the two through holes 75 respectively.

As shown in FIG. 3, one end portion of the plate member 91 at which the pushing-up portion 94 and the pushing-down portion 93 are formed and a base end portion 91*a* of the plate member 91 which is the other end portion on a side opposite to said one end portion are disposed at a position above the rotational axis 81 of the rotary cam 80. The plate member 91 is swingably supported by an axis 95 extending in the X direction. Further, the plate member 91 is supported by the axis 95 to extend toward a side of the wiper 70. Namely, the one end portion of the plate member 91 at which the pushing-up portion 94 and the pushing-down portion 93 are formed is positioned between the rotary cam 80 and the platen 2 in a radial direction of the rotary cam 80 (in a direction along the ink-jetting surface 4*a*). One end of the lifting rod 92 is connected to a lower surface (back surface) of the plate member 91 at a position in the vicinity of the center thereof. The other end of the lifting rod 92 is brought in contact with the cam surface 83 of the rotary cam 80. The plate member 91 is urged or biased by the tension spring 96 in a direction in which the cam surface 83 is pushed by the lifting rod 92.

Figure 6B:
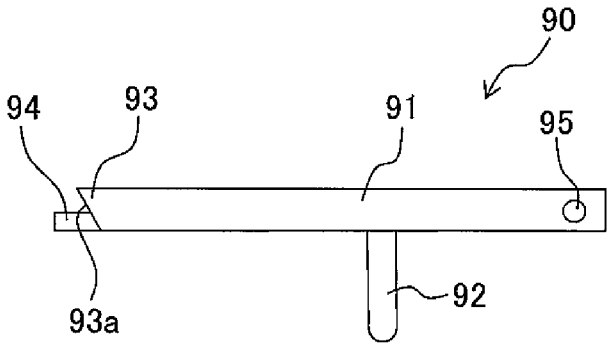
FIG. 6B is a side view as viewed in a direction of an arrow VIB of FIG. 6A.

The two pushing-down portions 93 are inserted into the two through holes 75 of the wiper 70, respectively. Further, the two pushing-up portions 94 are arranged to be capable of making contact with lower portions of the two protruding portions 74 of the wiper 70. Then, as shown in FIG. 6B, the pushing-up portion 94 has a thickness thinner than that of the pushing-down portion 93; and the lower surface of the pushing-up portion 94 is coplanar with the lower surface of the pushing-down portion 93.

A front end of the pushing-down portion 93 is obliquely inclined; and an upper surface of the pushing-down portion 93 makes an acute angle with an inclined surface 93*a*. A distance between the upper surface of the pushing-down portion 93 and an upper surface of the pushing-up portion 94 is shorter than a distance between the lower surface of the protruding portion 74 and the inner wall surface 75*a* of the wiper holder 72. The arm member 90 swings depending on rotation of the rotary cam 80 to move the wiper 70 between the wiping position and the retract position. Noted that the pushing-up portion 94 of the arm member 90 in this embodiment is an example of an action portion of the present teaching, the base end portion of the arm member 90 is an example of a support portion of the present teaching, and the pushing-down portion 93 of the arm member 90 is an example of an engagement release portion of the present teaching.

Figure 7A:
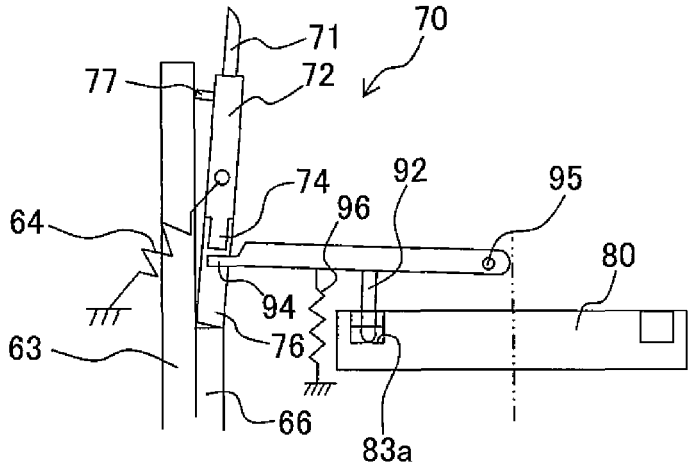
FIGS. 7A, 7B, and 7C are illustrative views each illustrating a process of movement to an upward direction of the wiper.
Figure 7B:
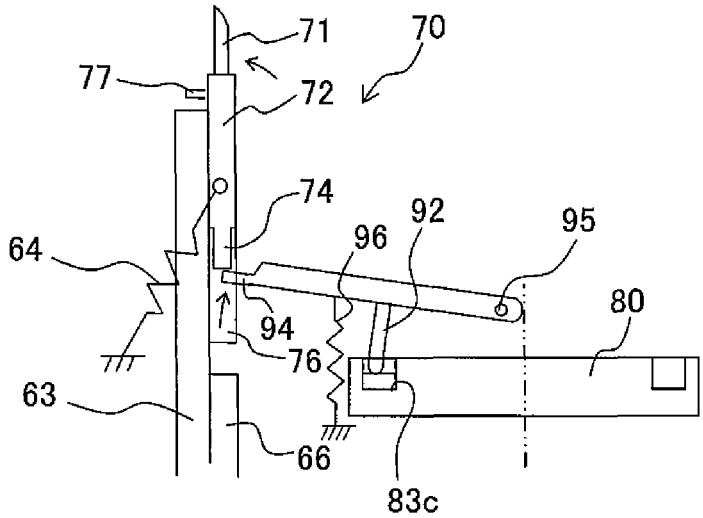
Figure 7C:
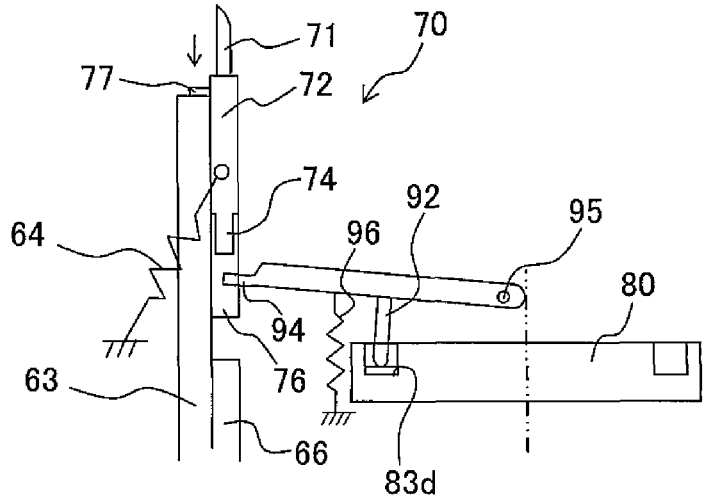

Next, an explanation will be made about a process of movement of the wiper 70 in the upward and downward directions. At first, the process of movement of the wiper 70 in the upward direction will be explained with reference to FIGS. 7A to 7C. Noted that the wiper 70 as shown in each of the FIGS. 7A to 7C is shown as a cross-sectional view taken along line VII-VII in FIG. 4. As shown in FIG. 7A, when the wiper 70 is located at the retract position, the stopper contact portion 76 is pulled downward by the biasing force of the tension spring 64 to make contact with the stopper 66. In this situation, since the projection 77 of the wiper 70 makes contact with a surface, of the support plate 63, on a side opposite to the printing area, the wiper 70 is inclined in the scanning direction as whole. Further, in this situation, the lifting rod 92 of the arm member 90 is brought in contact with the separating surface 83*a* of the rotary cam 80; and the arm member 90 does not make contact with the wiper 70.

When the rotary cam 80 is rotated in a direction shown by the arrow of FIG. 5A (clockwise direction), the lifting rod 92 of the arm member 90 is moved upward on the inclined surface 83*b* to arrive at the engaging surface 83*c*. Then, a front end which is one of the end portions of the arm member 90 (hereinafter referred to as "front end") is moved upward with the base end portion 91*a* supported by the axis 95 as the center.

As shown in FIG. 7B, when the front end of the arm member 90 is moved upward, the pushing-up portion 94 of the arm member 90 makes contact with the protruding portion 74 of the wiper holder 72 to push the wiper 70 upward against the basing force of the tension spring 64. When the projection 77, which is formed on the surface of the wiper 70 on the side of the printing area, is moved upwardly as compared with the upper surface of the support plate 63, the wiper 70 is provided upstandingly to be parallel to the upward and downward directions by being pulled toward the support plate 63 by the biasing force of the tension spring 64 to incline in the counterclockwise direction of FIG. 7B, with the base end contacting with the support plate 63 as the center.

Thereafter, the lifting rod 92 of the arm member 90 is brought in contact with the standby surface 83*d* from the engaging surface 83*c* via the stepped portion by further rotating the rotary cam 80 in a state that the projection 77 of the wiper 70 and the support plate 63 are overlapped in the upward and downward directions with each other. In this situation, the front end of the arm member 90 is moved downward with the base end portion 91*a* as the center, thereby releasing a state that the pushing-up portion 94 of the arm member 90 is brought in contact with the protruding portion 74 of the wiper holder 72.

Then, as shown in FIG. 7C, when the wiper 70 is moved downward by the biasing force of the tension spring 64, the projection 77 of the wiper 70 is brought in contact with the upper surface of the support plate 63 to regulate the movement of the wiper 70 to the downward direction. At this height position, the front end of the wiper 70 can make contact with the ink-jetting surface 4*a*. Accordingly, the wiper 70 is positioned at the wiping position at which the wiper 70 can make contact with the ink-jetting surface 4*a*. Noted that the projection 77 of the wiper 70 and the support plate 63 in this embodiment are examples of an engaging member, of the present teaching, which engages the wiper 70 at the wiping position at which the wiper 70 can make contact with the ink jetting surface 4*a*.

Next, an explanation will be made about the process of movement of the wiper 70 to the downward direction. There are two methods: a method for using the wiper movement mechanism 65 and a method for using the movement of the ink-jet head 4 in the scanning direction, as a method for moving the wiper 70 downward from the wiping position to the retract position.

At first, the method for using the wiper movement mechanism 65 will be explained with reference to FIGS. 8A to 8D. Noted that the wiper 70 shown in each of the FIGS. 8A to 8D is shown as a cross-sectional view taken along line VIII-VIII in FIG. 4.

Figure 8A:
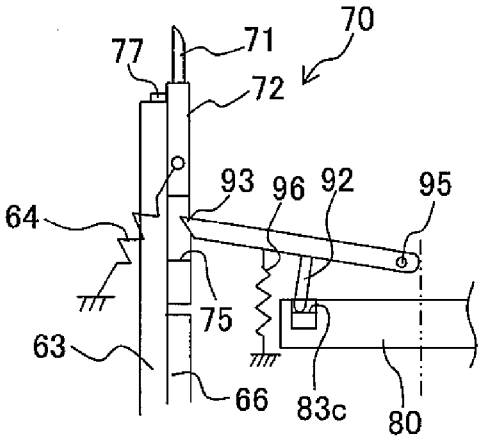
FIGS. 8A, 8B, 8C, and 8D are illustrative views each illustrating a process of movement to a downward direction of the wiper by using the wiper movement mechanism.
Figure 8B:
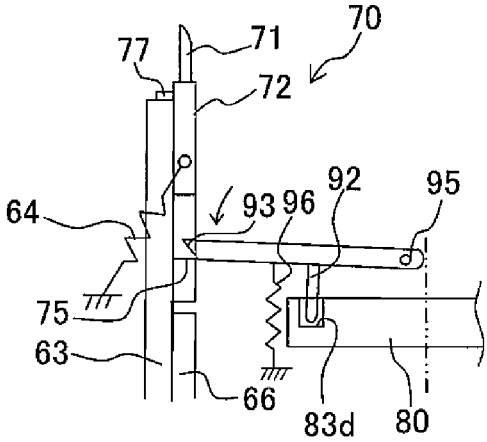

As shown in FIG. 8A, in a state that the wiping member 70 is positioned at the wiping position and that the lifting rod 92 of the arm member 90 is brought in contact with the standby surface 83*d*, the pushing-down portion 93 of the arm member 90 does not contact with any surface in the through hole 75. When the lifting rod 92 moves to the separating surface 83*a* from the standby surface 83*d* via the stepped portion, the arm member 90 is pulled by the biasing force of the tension spring 96 and the front end of the arm member 90 is moved downward with the base end portion as the center. Then, as shown in FIG. 8B, the inclined surface 93*a* of the pushing-down portion 93 of the arm member 90 makes contact with an end surface of the inner wall surface 75*b* of the wiper holder 72, thereby forming a gap having the acute angle between the inclined surface 93*a* and the inner wall surface 75*b*.

Figure 8C:
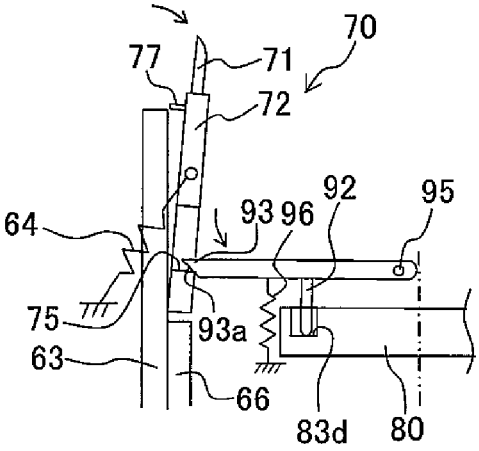
Figure 8D:
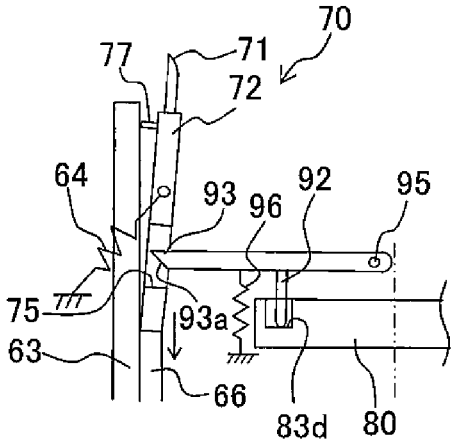

When the front end of the arm member 90 is moved further downward, as shown in FIG. 8C, the inner wall surface 75*b* makes surface contact with the inclined surface 93*a* and thereby the wiper 70 inclines in the clockwise direction of FIG. 8C, with the base end as an axis. Accordingly, a contact state between the projection 77 of the wiper 70 and the support plate 63 is released. The wiper 70 slidably moves in the downward direction by the biasing force of the tension spring 64, in a state that the projection 77 and the base end of the wiper 70 are brought in contact with the support plate 63. Then, as shown in FIG. 8D, the wiper 70 is pulled by the biasing force of the tension spring 64 in the downward direction until the stopper contact portion 76 of the wiper 70 makes contact with the stopper 66 to be moved to the retract position. In this situation, the lifting rod 92 of the arm member 90 is brought in contact with the separating surface 83*a*, and the arm member 90 does not make contact with the wiper 70.

Figure 9A:
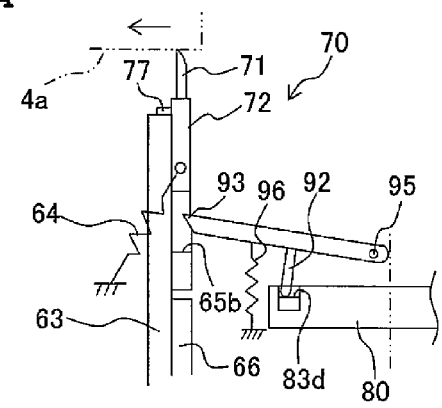
FIGS. 9A, 9B, and 9C are illustrative views each illustrating a process of movement to the downward direction of the wiper by using movement of an ink-jet head in the scanning direction.
Figure 9B:
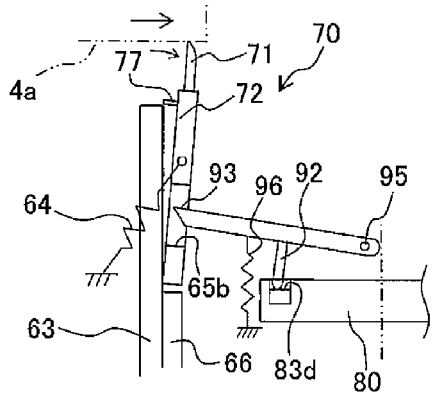
Figure 9C:
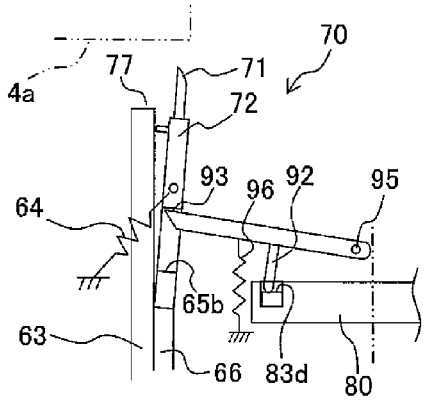

Next, the method for using the movement of the ink-jet head 4 in the scanning direction will be explained with reference to FIGS. 9A to 9C. Noted that the wiper 70 shown in each of the FIGS. 9A to 9C is shown as the cross-sectional view taken along line VIII-VIII in FIG. 4. As shown in FIG. 9A, in the state that the wiping member 70 is positioned at the wiping position and that the lifting rod 92 of the arm member 90 is brought in contact with the standby surface 83*d*, the pushing-up portion 94 of the arm member 90 does not make contact with the protruding portion 74 of the wiper holder 72.

Then, as shown in FIG. 9B, the ink-jet head 4 is moved, together with the carriage 3, toward the side of the suction cap 21 in the scanning direction (from left side to right side in FIG. 9B) so as to bring the ink-jet head 4 back to the maintenance position. In this situation, the wiper 70 also moves from the left side to the right side in FIG. 9B. Then, the wiper 70 inclines in the clockwise direction of FIG. 9B, with the end portion as the axis.

When the contact state between the projection 77 of the wiper 70 and the support plate 63 is released, the wiper 70 slidably moves in the downward direction by the biasing force of the tension spring 64, in the state that the projection 77 and the base end of the wiper 70 are brought in contact with the support plate 63. That is, the wiper 70 moves toward a retract position disposed below while moving from the left side to the right side in FIG. 9B. Then, as shown in FIG. 9C, the wiper 70 is pulled by the biasing force of the tension spring 64 in the downward direction until the stopper contact portion 76 of the wiper 70 makes contact with the stopper 66 to be moved to the retract position.

According to the ink-jet printer 1 in this embodiment, the arm member 90 swings with the base end portion supported by the axis 95 as the center, when the lifting rod 92 moves in cooperation with the movement of the rotary cam 80. Then, the front end of the arm member 90 makes contact with the wiper 70 to push and move the wiper 70 so that the wiper 70 is moved closer to the ink-jetting surface 4*a* to be brought in contact with the ink-jetting surface 4*a*. In this situation, a tilt of the wiper 70 around an axis which connects the front end of the arm member 90 and the base end, that is, a tilt of the wiper 70 in a tangential direction with respect to a rotating path of the rotary cam 80, is regulated by supporting the arm member 90 by the axis 95, and thereby moving the wiper 70 closer to the ink-jetting surface 4*a* in the correct posture without inclining the wiper 70 obliquely. Similarly, the wiper 70 can be separated from the ink-jetting surface 4*a* in the correct posture without being inclined obliquely.

Further, in a case that the wiper 70 is moved downward by the wiper movement mechanism 65 under the condition that the cam surface 83 of the rotary cam 80 has only two surfaces (the engaging surface 83*c* and the separating surface 83*a*), the wiper 70 is required to be moved to the downward direction when the lifting rod 92 of the arm member 90 is moved from the engaging surface 83*c* to the separating surface 83*a*. Therefore, in the case that the wiper 70 is moved to the downward direction by using the movement of the ink-jet head 4 in the scanning direction, the lifting rod 92 of the arm member 90 is required to be positioned at the engaging surface 83*c*. In this situation, however, the pushing-up portion 94 of the arm member 90 makes contact with the protruding portions 74 of the wiper 70, and thus it is not possible to move the wiper 70 to the downward direction.

In this embodiment, the standby surface 83*d* is provided between the engaging surface 83*c* and the separating surface 83*a*; and the arm member 90 does not make contact with the wiper 70 in the state that the lifting rod 92 of the arm member 90 is brought in contact with the standby surface 83*d*. Accordingly, the two methods (the method for using the wiper movement mechanism 65 and the method for using the movement of the ink-jet head 4 in the scanning direction) can be used to move the wiper 70 downward from the wiping position to the retract position.

By the way, the rotary cam 80 is usually disposed at a position immediately below the suction cap 21; and a position of the rotational axis 81 can not be changed due to restriction of arrangements of various gears etc. Further, the larger the number of nozzles 16 is, the larger an area of the ink-jetting surface 4*a* is. In accordance with this, the suction cap 21 also increases in size. Accordingly, if the rotary cam 80 is arranged at a position immediately below the wiper 70 disposed adjacently to the suction cap 21, the rotary cam 80 is required to be increased in size. Alternatively, in a construction in which the suction cap 21 is driven obliquely upward in the scanning direction by the above-described elevating mechanism to be separated from the printing area, the wiper 70 can not be arranged closely to the side of the printing area in the scanning direction of the suction cap 21; and the wiper 70 is arranged to be separated by at least a distance corresponding to an area where the suction cap 21 moves obliquely upward. Even in such a case, the rotary cam 80 is required to be increased in size if the rotary cam 80 is arranged at the position immediately below the wiper 70. However, in a case that the rotary cam 80 in a circular shape is increased in size, the rotary cam 80 is increased in size not only in the direction in which the suction cap 21 is adjacent to the wiper 70 (Y direction) but also in the X direction. Thus, the ink-jet printer 1 increases in size. For this reason, in some cases, it is difficult to arrange the rotary cam 80 at the position immediately below the wiper 70.

In this embodiment, in the case that it is difficult to arrange the wiper 70 at the position immediately above the rotary cam 80 due to the restriction of the arrangement and that the wiper 70 is arranged at the position separated from the rotary cam 80, the wiper 70, which is arranged at the position separated from the rotary cam 80, can be pushed and moved, via the arm member 90, to be closer to the ink-jetting surface 4*a*. Accordingly, degree of freedom of the arrangement of the wiper 70 is enhanced without increasing the ink-jet printer 1 in size and without being restricted by the arrangement of the rotary cam etc.

Next, modified embodiments in which various modifications are made in the embodiment will be described below. However, the constitutive parts or components, which are the same as or equivalent to those of the embodiment described above, are designated by the same reference numerals, any explanation of which will be omitted as appropriate.

In this embodiment, the wiper 70 is disposed at the position separated from the rotary cam 80 with respect to the surface parallel to the ink-jetting surface 4*a*. However, the wiper 70 may be disposed in the vicinity of the rotary cam 80, for example, at a position immediately above the rotary cam 80, provided that the wiper 70 is driven upward and downward by the swingable arm member 90 with the axis 95 as the center.

In this embodiment, the inner wall surface 75*b* is pushed down by the lower surface of the pushing-down portion 93 inserted into the through hole 75 of the wiper holder 72 to move the wiper 70 downward; and the protruding portion 74 of the wiper holder 72 is pushed up by the upper surface of the pushing-up portion 94 to move the wiper 70 upward. However, the following configuration is also allowable. That is, the inner wall surface 75*b* is pushed down by the lower surface of the pushing-down portion 93 inserted into the through hole 75 of the wiper holder 72 to move the wiper 70 downward; and the inner wall surface 75*a* is pushed up by the upper surface of the pushing-down portion 93 to move the wiper 70 upward without providing the pushing-up portion 94 in the arm member 90 and without providing the protruding portion 74 in the wiper holder 72.

In this embodiment, the surface of the pushing-down portion 93 of the arm member 90 which makes contact with the inner wall surface 75*b* of the wiper holder 72 may be a surface other than the inclined surface 93*a*, provided that the surface is inclined to the inner wall surface 75*b*. For example, the surface may be brought in contact with the inner wall surface 75*a* obliquely.

In this embodiment, two spots, which are provided on both sides in a width direction of the wiper 70 (X direction), are pushed up and down. However, only one spot, such as the center in the width direction of the wiper 70, or a plurality of spots may be pushed up and down.

In this embodiment, the description is made by citing the rotary cam 80. However, it is allowable to use any cam such as an eccentric cam or a linear cam. The cam surface is not limited to the cam groove; and may be formed on a circumferential surface of the cam.

In this embodiment, a timing at which the wiping operation to wipe the ink-jetting surface 4*a* by the wiper 70 is performed is explained by citing the case in which the wiping operation is performed after the suction purge in which the ink is sucked and discharged from the nozzles 16. However, the wiping operation may be performed at any timing For example, the wiping operation may be performed in a case that the printing operations are performed a plurality of times and thereby a part of the ink discharged from the nozzles 16 is more likely to be adhered to the ink-jetting surface 4*a*.

In this embodiment, the wiper 70 is moved, relative to the ink-jetting surface 4*a*, in the wiping direction parallel to the scanning direction, by utilizing the movement of the serial-type ink-jet head 4 in the scanning direction. However, the present teaching is not limited thereto. For example, the present teaching is applicable to the line-type ink-jet head. In this case, a moving mechanism to move the wiper 70 in the wiping direction may be provided to move the wiper 70, relative to the ink-jetting surface 4*a*, in the wiping direction.

The embodiment and the modified embodiments thereof explained above are examples in which the present teaching is applied to the ink-jet printer for recording, for example, the image by jetting the ink to the recording paper sheet P. However, the application objective of the present teaching is not limited to the ink-jet printer as described above. The present teaching is applicable to any liquid jetting apparatuses usable in various technical fields.

What is claimed is:

1. A liquid jetting apparatus which jets liquid, comprising:

a liquid jetting head configured to have a liquid jetting surface on which a plurality of nozzles, from which the liquid is jetted, are open;

a wiper having a through hole formed therein, and configured to move, relative to and along the liquid jetting surface, while being brought in contact with the liquid jetting surface and to wipe the liquid adhered on the liquid jetting surface;

a wiper movement mechanism configured to move the wiper in a first direction, which is orthogonal to the liquid jetting surface and approaches to the liquid jetting surface, and a second direction which is an opposite direction of the first direction; and to make the wiper approach to or separate from the liquid jetting surface;

wherein the wiper movement mechanism includes:

a cam configured to have a cam surface;

an axis configured to extend along the liquid jetting surface;

an arm member configured to make the wiper approach to the liquid jetting surface by pushing and moving the wiper in accordance with movement of the cam; and an engaging member configured to engage the wiper at a wiping position at which the wiper makes contact with the liquid jetting surface, wherein the arm member includes:

a contact portion configured to make contact with the cam surface and to move in the first direction and the second direction;

a support portion configured to be supported by the axis at a first position which is different from the contact portion;

an action portion configured to make contact with the wiper and to make the wiper approach to the liquid jetting surface by pushing and moving the wiper in a state of being brought in contact with the action portion in accordance with movement of the contact portion, the action portion disposed at a second position which is different from the first position; and an engagement release portion configured to make contact with the wiper and to release engagement of the wiper by the engaging member by pushing and moving the wiper in a state of making contact with the arm member in accordance with the movement of the contact portion, wherein the engagement release portion of the arm member penetrates into the through hole and is swingable around the axis in the through hole, and wherein the engagement release portion swings in the through hole of the wiper, makes contact with an inner wall surface forming the through hole, and pushes and moves the inner wall surface, in a case that the wiper is separated from the liquid jetting surface.

2. The liquid jetting apparatus according to claim 1, wherein the arm member extends outside the cam with respect to a direction parallel to the liquid jetting surface and the action portion is provided at an end portion of the arm member extending outside the cam; and the wiper is disposed at a third position outside the cam at which the action portion makes contact with the wiper.

3. The liquid jetting apparatus according to claim 1, wherein the wiper movement mechanism further includes a first urging member configured to urge the wiper in the second direction;

the action portion makes contact with the wiper in a case that the wiper approaches to the liquid jetting surface;

the engagement release portion makes contact with the wiper in a case that the wiper is separated from the liquid jetting surface;

the cam surface includes at least two surfaces of a first surface and a second surface;

the action portion makes contact with the wiper in a state that the contact portion is brought in contact with the first surface;

the engagement release portion makes contact with the wiper in a state that the contact portion is brought in contact with the second surface; and under a condition that the contact portion makes contact with the second surface in a state that the wiper is engaged with the engaging member, the engagement release portion makes contact with the wiper and the wiper is inclined with respect to the engaging member with a based end portion of the wiper as a fulcrum to release the engagement with the engaging member.

4. The liquid jetting apparatus according to claim 1, wherein a surface, of the engagement release portion, which makes contact with the inner wall surface is inclined with respect to the inner wall surface, in a state that the surface is brought in contact with the inner wall surface.

5. The liquid jetting apparatus according to claim 4, wherein the wiper is formed with a protruding portion which protrudes in a direction further away from the liquid jetting surface than a portion, of the inner wall surface forming the through hole, which is closest to the liquid jetting surface;

the arm member is formed so that the action portion and the engagement release portion are branched from the arm member; and the action portion makes contact with the protruding portion.

6. The liquid jetting apparatus according to claim 3, wherein the wiper movement mechanism further includes a second urging member configured to urge the arm member in the second direction.

7. The liquid jetting apparatus according to claim 1, wherein a rotational axis of the cam is perpendicular to the liquid jetting surface.

* * * * *